US006848345B2

(12) United States Patent
Lin

(10) Patent No.: US 6,848,345 B2
(45) Date of Patent: Feb. 1, 2005

(54) ADJUSTABLE HEAD FOR A WRENCH

(76) Inventor: Yen-Wen Lin, 13F, No. 27, Lane 93, Liu Yang W. Street, Taichung (TW)

( * ) Notice: Subject to any disclaimer, the term of this patent is extended or adjusted under 35 U.S.C. 154(b) by 0 days.

(21) Appl. No.: 10/751,288

(22) Filed: Jan. 2, 2004

(65) Prior Publication Data

US 2004/0144219 A1 Jul. 29, 2004

(30) Foreign Application Priority Data

Jan. 28, 2003 (TW) ..... 92102140 A

(51) Int. Cl.[7] ..... B25B 23/16

(52) U.S. Cl. ..... 81/177.8; 81/177.7; 81/177.9; 403/91

(58) Field of Search ..... 81/177.8, 177.7, 81/177.9, 60; 403/91, 92, 97, 84

(56) References Cited

U.S. PATENT DOCUMENTS 5,916,339 A * 6/1999 Dumont ..... 81/63.1
6,148,698 A * 11/2000 Hsieh ..... 81/177.8
6,745,650 B1 * 6/2004 Chang ..... 81/177.8

* cited by examiner

*Primary Examiner*—D. S. Meislin
*Assistant Examiner*—Alvin J. Grant
(74) *Attorney, Agent, or Firm*—Alan D. Kamrath; Nikolai & Mersereau, P.A.

(57) ABSTRACT

A wrench includes a handle, a head having a pivotal portion, and a retaining mechanism for retaining the head in the desired angular position relative to the handle. The pivotal portion of the head includes a fore lug and a rear lug that are located with reference to a ratcheting direction of the handle. The handle has an engaging portion pivotally received in an opening between the lugs. Teeth are defined in an arcuate outer surface section of the fore lug. The thickness of the rear lug is not reduced, avoiding damage to the torque-bearing section in the pin hole of the rear lug.

9 Claims, 9 Drawing Sheets

ADJUSTABLE HEAD FOR A WRENCH

BACKGROUND OF THE INVENTION

1. Field of the Invention

The present invention relates to an adjustable head for a wrench. In particular, the present invention relates to a wrench including a handle and a head that can be pivotally adjusted to and retained in a desired angular position relative to the handle.

2. Description of the Related Art

FIG. 1 of the drawings illustrates a conventional wrench including a handle 2 and a head 1 that can be pivotally adjusted to a desired angular position relative to the handle 2. FIG. 2 is a top view of the head 1, and FIG. 3 is a side view of the head 1.

The head 1 includes a pair of lugs 12 on a side thereof, with teeth 121 being defined along an arcuate outer surface section of the respective lug 12. A pin 14 is extended through aligned pin holes 122 in the lugs 12 and a pin hole 22 in an engaging portion 21 formed on an end of the handle 2, thereby pivotally connecting the lugs 12 of the head 1 to the engaging portion 21 of the handle 2.

In this wrench; formation of the teeth 121 along an entire arcuate outer surface section of the respective lug 12 of the head 10 causes a reduction in the thickness; namely, the distance from a periphery delimiting the hole 122 of the respective lug 12 to the dedendum circle of the teeth 121 is "L". As illustrated in FIG. 1, the respective lug 12 is subjected to a torque at sections 122*a* and 122*b* when the wrench is turned clockwise for driving a fastener. Cracks 13 are apt to be generated in the torque-bearing section 122*b* when the handle 2 is turned clockwise. The torque-bearing section 122*b* is damaged when the torque applied to the wrench is relatively large. The device for retaining the head 1 in a desired angular position relative to the handle 2 sacrifices the torque-bearing capacity of the wrench.

SUMMARY OF THE INVENTION

In accordance with an aspect of the invention, a wrench with an adjustable head includes a handle having an engaging portion, a head having a pivotal portion, and a retaining mechanism allowing the head to be pivotally moved to a desired angular position relative to the handle and retaining the head in the desired angular position.

The pivotal portion of the head includes a fore lug and a rear lug that are located with reference to a ratcheting direction of the handle. An opening is defined between the fore lug and the rear lug. The engaging portion of the handle is received in the opening and pivotable about a pivotal axis. Each of the fore lug and the rear lug includes an arcuate outer surface section. A plurality of teeth are defined in the arcuate outer surface section of the fore lug. A distance from an dedendum circle of the teeth of the fore lug to the pivotal axis is smaller than that from the arcuate outer surface section of the rear lug to the pivotal axis.

Since the thickness of the rear lug is not reduced, it is less likely to crack or damage the torque-bearing section in the pin hole of the rear lug. Namely, the torque-bearing capacity of the wrench is not sacrificed even though the head is designed to be pivotably adjusted to a desired angular position relative to the handle.

Other objectives, advantages, and novel features of the invention will become more apparent from the following detailed description when taken in conjunction with the accompanying drawings.

DETAILED DESCRIPTION OF THE PREFERRED EMBODIMENTS

Figure 4:
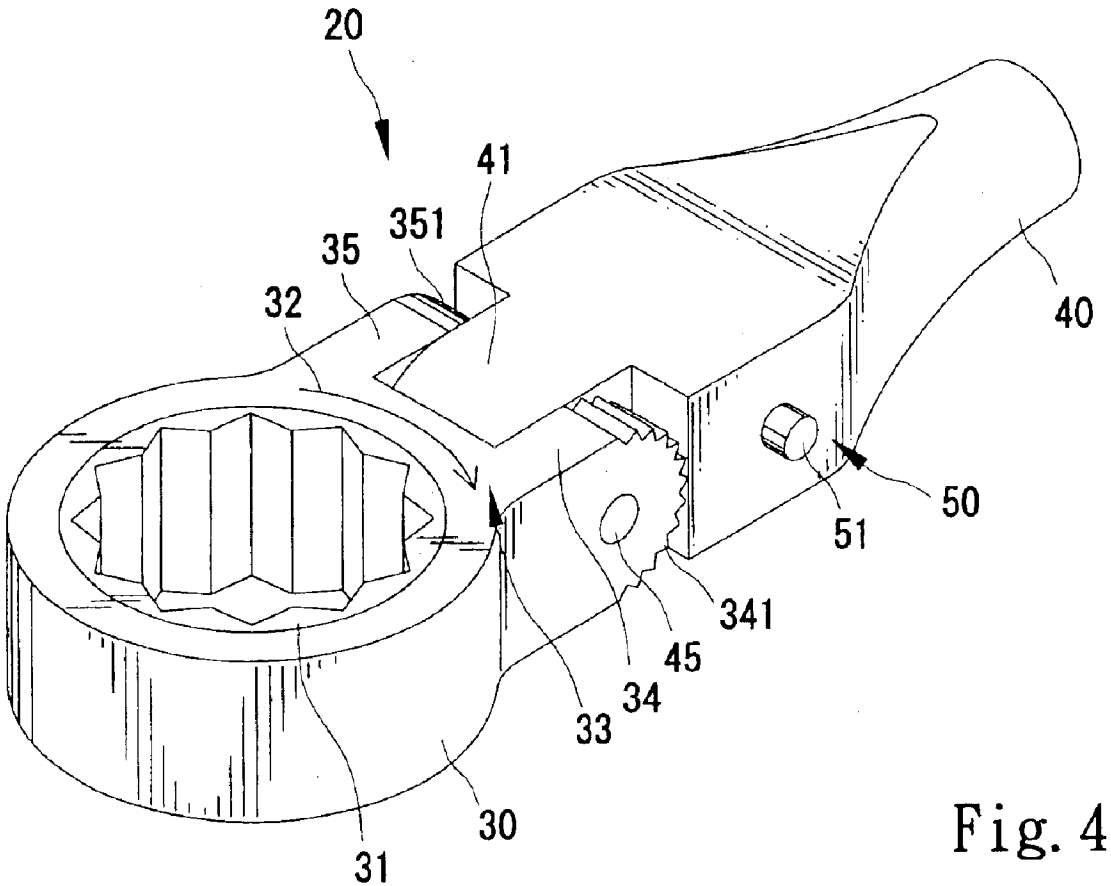
FIG. 4 is a perspective view of a wrench in accordance with the present invention.
Figure 5:
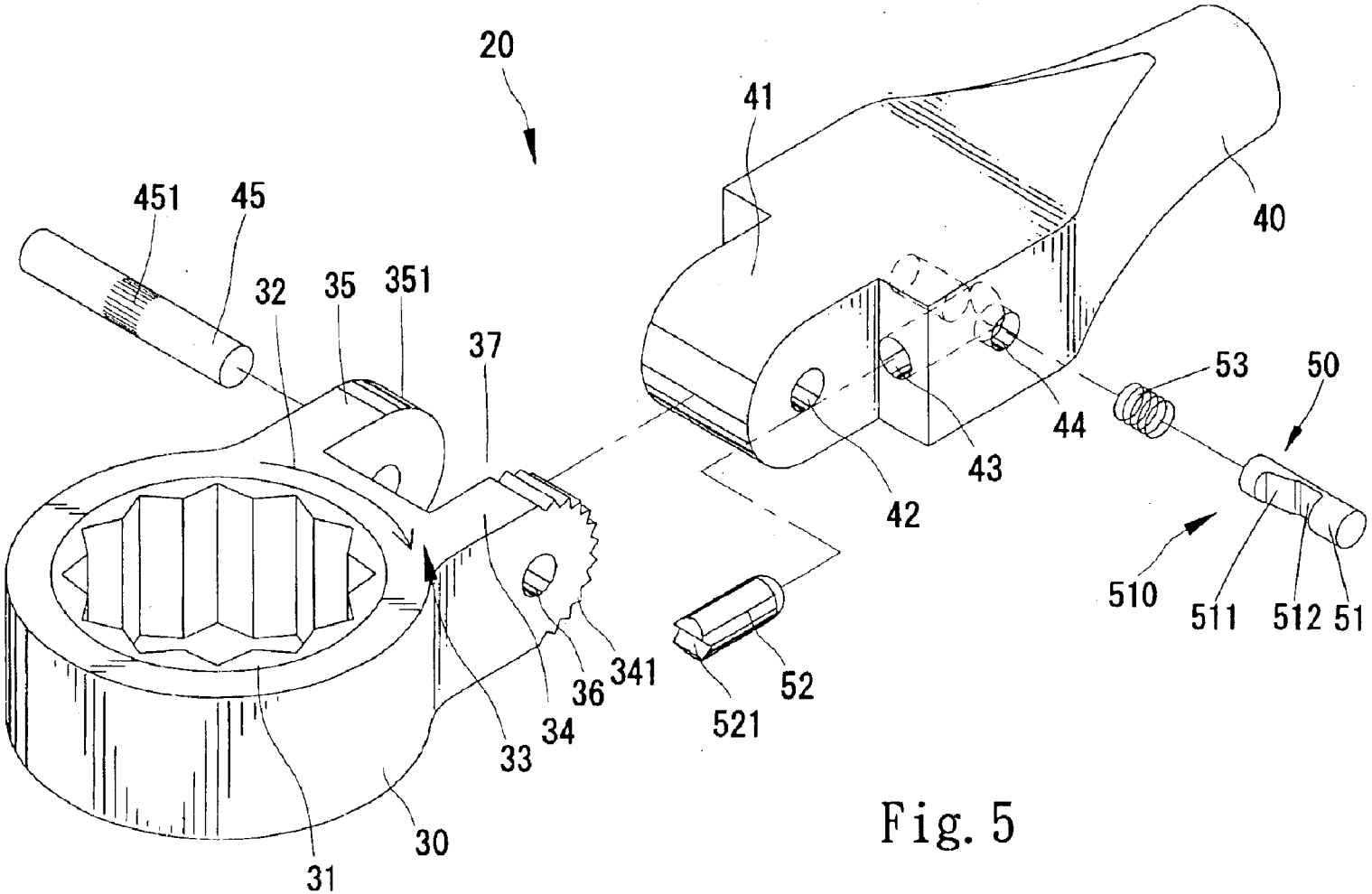
FIG. 5 is an exploded perspective view of the wrench in accordance with the present invention.

Referring to FIGS. 4 and 5, a wrench 20 in accordance with the present invention generally comprises a handle 40 and a head 30 that can be pivotally adjusted to a desired angular position relative to the handle 40.

Figure 1:
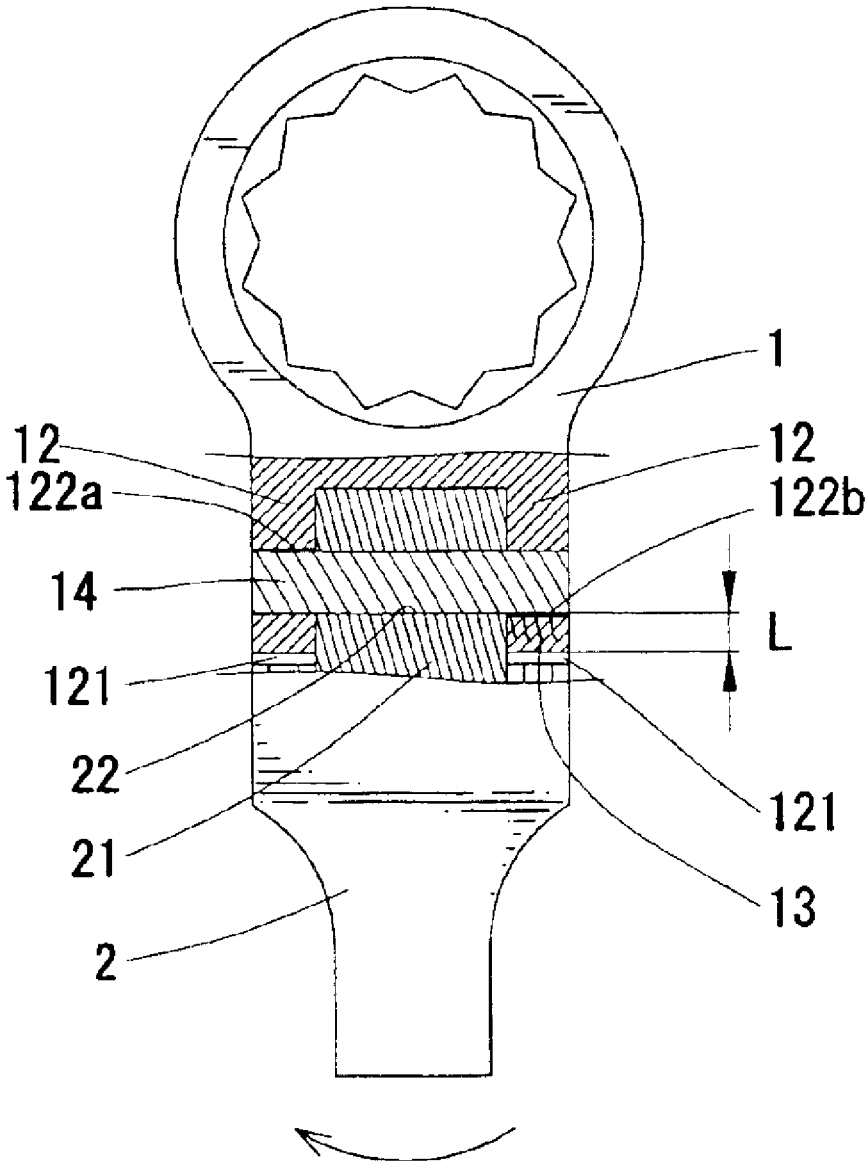
Fig. 1 PRIOR ART
FIG. 1 is a top view, partly sectioned, of a conventional wrench.
Figure 3:
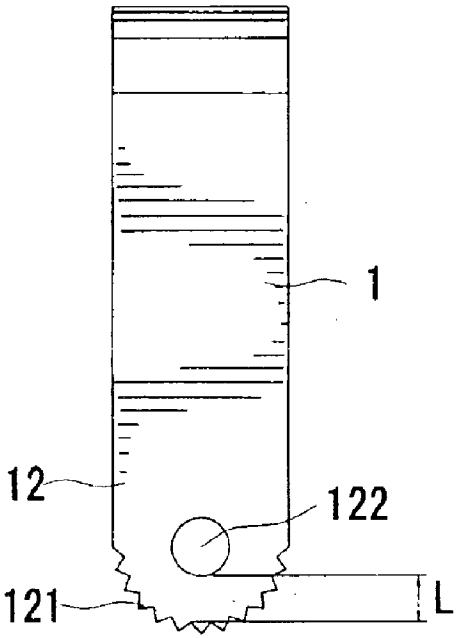
Fig. 3 PRIOR ART
FIG. 3 is a side view of the head in FIG. 2.
Figure 2:
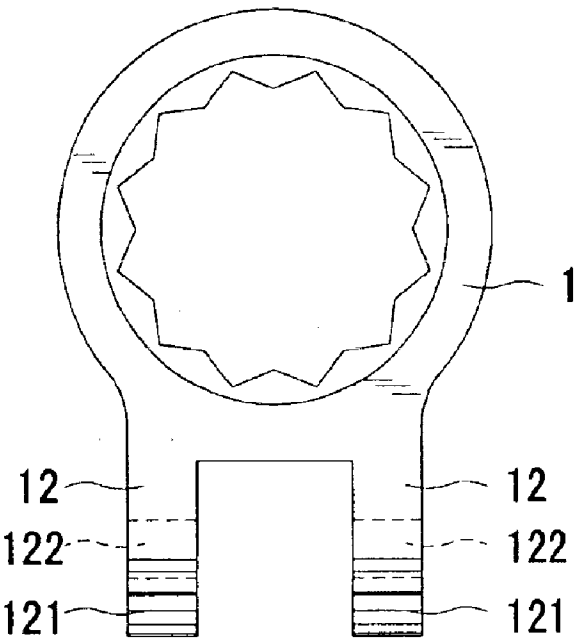
Fig. 2 PRIOR ART
FIG. 2 is a top view of a head of the conventional wrench in FIG. 1.
Figure 7:
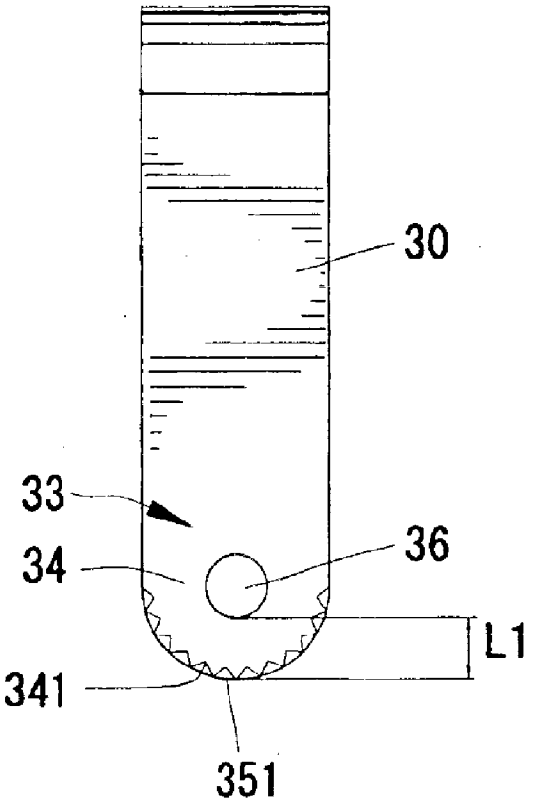
FIG. 7 is a side view of the head in FIG. 6.
Figure 6:
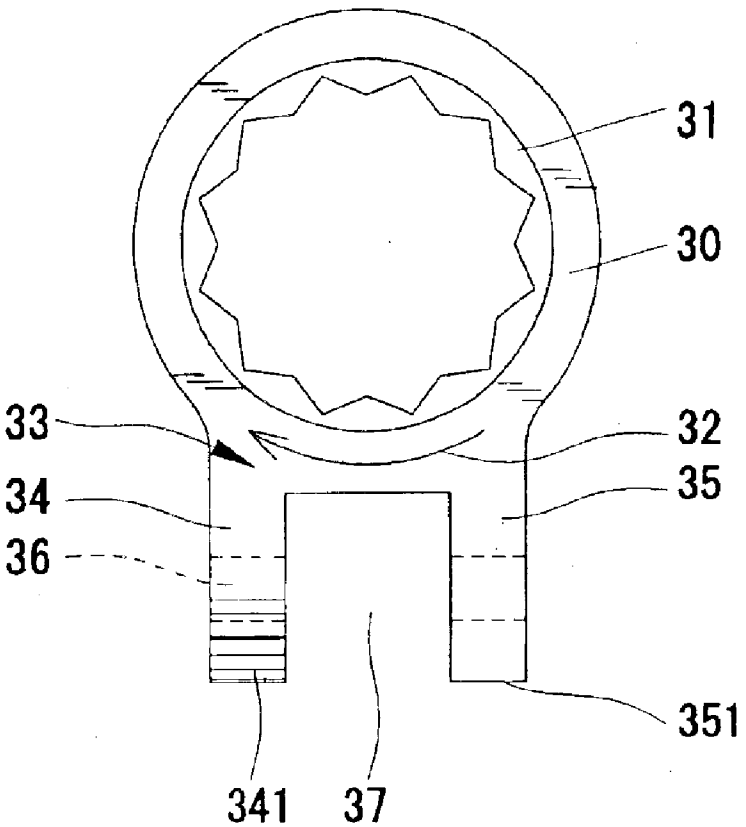
FIG. 6 is a top view of a head of the wrench in FIG. 5.

The head 30 includes a drive member 31 mounted therein for driving a fastener along a direction indicated by a mark 32 on the head 30, which is conventional and therefore not described in detail. The head 30 further has a pivotal portion 33 formed on a side of the head 30. In this embodiment, the pivotal portion 33 includes a fore lug 34 and a rear lug 35 having aligned pin holes 36, with an opening 37 being defined between the lugs 34 and 35. The terms "fore" and "rear" used herein are referred to with reference to the ratcheting direction of the wrench (see the mark 32). Namely, the fore lug 34 is located in front of the rear lug 35 when viewed from the ratcheting direction of the handle 40 (i.e., the direction indicated by the mark 32). The fore lug 34 has a plurality of teeth 341 defined in an arcuate outer surface section thereof. As illustrated in FIG. 7, a distance from a periphery delimiting the pin hole 36 of the rear lug 35 to an arcuate outer surface section 351 of the rear lug 35 is "L1", which is greater than "L" in the conventional wrench (see FIGS. 1 through 3) of the same size. Further, the distance from the dedendum circle of the teeth 341 of the fore lug 34 to a longitudinal axis (i.e., the pivotal axis) of the pin holes 36 is smaller than that from the arcuate outer surface section 351 of the rear lug 35 to the pivotal axis, as shown in FIGS. 6 and 7.

The handle 40 includes an engaging portion 41 on an end thereof. In this embodiment, the engaging portion 41 is in the form of a protrusion that is pivotally received in the opening 37 between the lugs 34 and 35 of the head 30 and that has a pin hole 42 extending in a direction transverse to a longitudinal direction of the handle 40. A pin 45 is extended through the pin holes 36 in the lugs 34 and 35 and the pin hole 42 of the engaging portion 41 of the handle 40, thereby pivotally connecting the engaging portion 41 of the handle 40 to the lugs 34 and 35 of the handle 30. Preferably, the pin 45 has an embossed section 451 allowing the pin 45 to be tightly mounted in the pin hole 42.

The end of the handle 40 further has a receptacle 44 extending in a direction perpendicular to the longitudinal direction of the handle 40. The receptacle 44 opens in one of two lateral sides of the handle 40. An axial hole 43 is defined in the end of the handle 40 and has a first end communicated with the receptacle 44 and a second end facing the teeth 341 of the fore lug 34. A retaining mechanism 50 is provided for retaining the head 30 in a desired angular position relative to the handle 40 and includes an elastic element 53, a push member 51, and a catch 52. The elastic element 53 and the push member 51 are mounted in the receptacle 44, and the catch 52 is slidably mounted in the axial hole 43 and has a toothed portion 521 in an end thereof. The push member 51 includes a recessed portion 510 having a first face 511 and a second face 512, both facing the head 30. The first face 511 and the second face 512 are located at different heights, and the other end of the catch 52 selectively abuts against one of the first face 511 and the second face 512. An end of the push member 51 is biased by the elastic element 53 to a position located beyond the receptacle 44 for manual operation.

Figure 8:
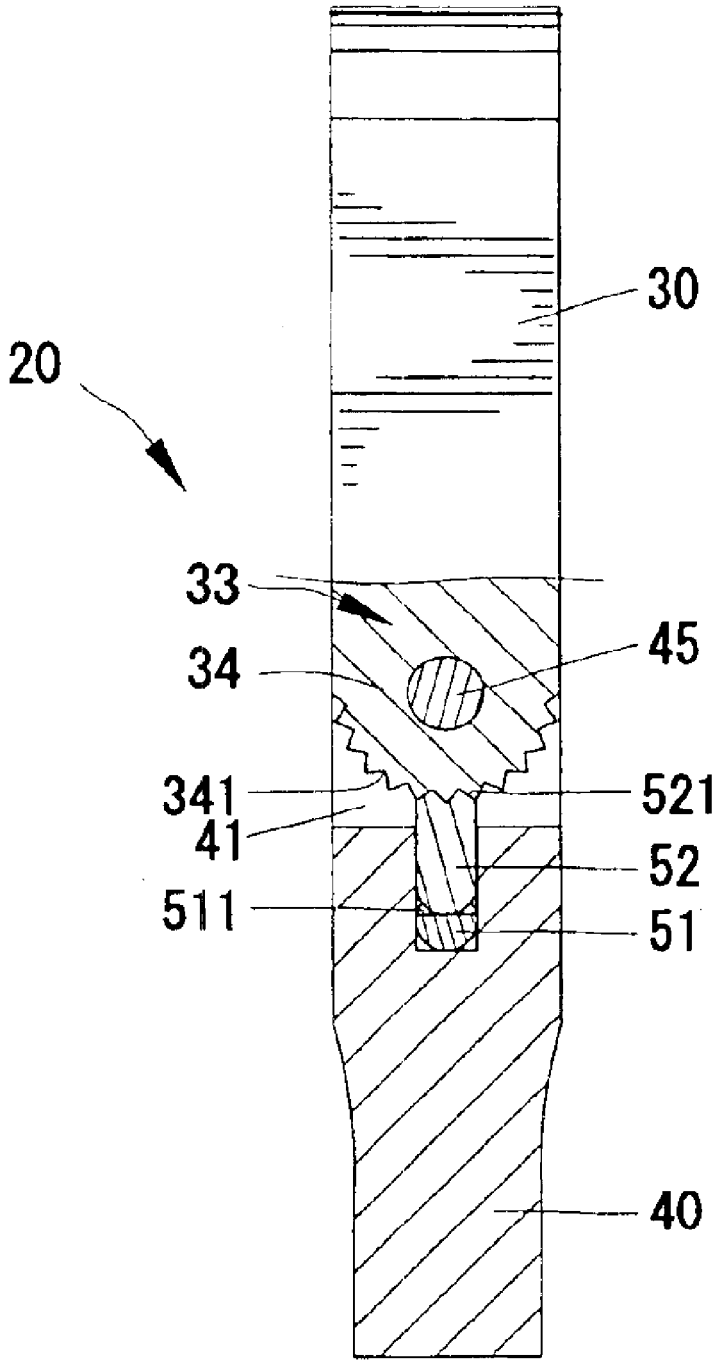
FIG. 8 is a side view, partly sectioned, of the wrench in FIG. 4.
Figure 9:
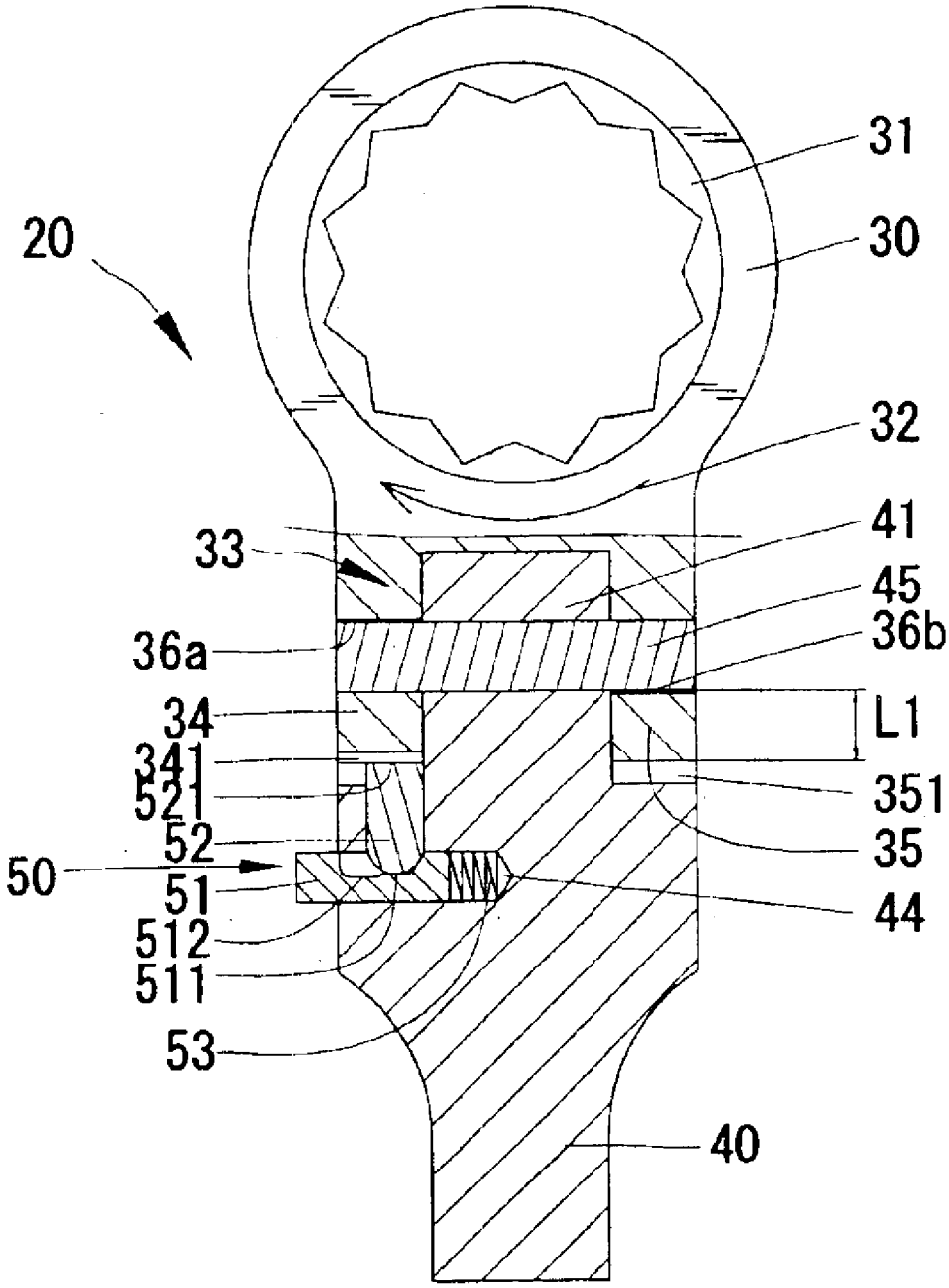
FIG. 9 is a top view, partly sectioned, of the wrench in FIG. 4.

In use, referring to FIGS. 8 and 9, the push member 51 is biased by the elastic element 53 such that the other end of the catch 52 presses against the first face 511 of the push member 51 and that the toothed portion 521 of the catch 52 is engaged with the teeth 341 of the fore lug 34 of the head 30. Thus, the head 30 is retained in a desired angular position relative to the handle 40, allowing joint rotation of the head 30 and the handle 40. When the push member 51 is pushed, the elastic element 53 is compressed, and the other end of the catch 52 presses against the second face 512 of the push member 51, and the toothed portion 521 of the catch 52 is allowed to be disengaged from the teeth 341 of the fore lug 34. Thus, the head 30 may be pivoted relative to the handle 40 until the head 30 reaches a desired angular position relative to the handle 40.

Still referring to FIG. 9, when turning the handle 40 clockwise, the head 30 turns together with the handle 40. The head 30 is subjected to a torque at sections 36*a* and 36*b* when the wrench is turned clockwise for driving a fastener. Since the thickness of the rear lug 35 is not reduced, it is less likely to crack or damage the torque-bearing section 36*b*. Namely, the torque-bearing capacity of the wrench is not sacrificed even though the head 30 is designed to be pivotably adjusted to a desired angular position relative to the handle 40. The drive member 31 is so configured that a fastener engaged with the drive member is tightened or loosened when the handle 40 is turned clockwise and that the fastener is not turned when the handle 40 is turned counterclockwise. Such a drive member 31 is conventional and therefore not described in detail.

Figure 10:
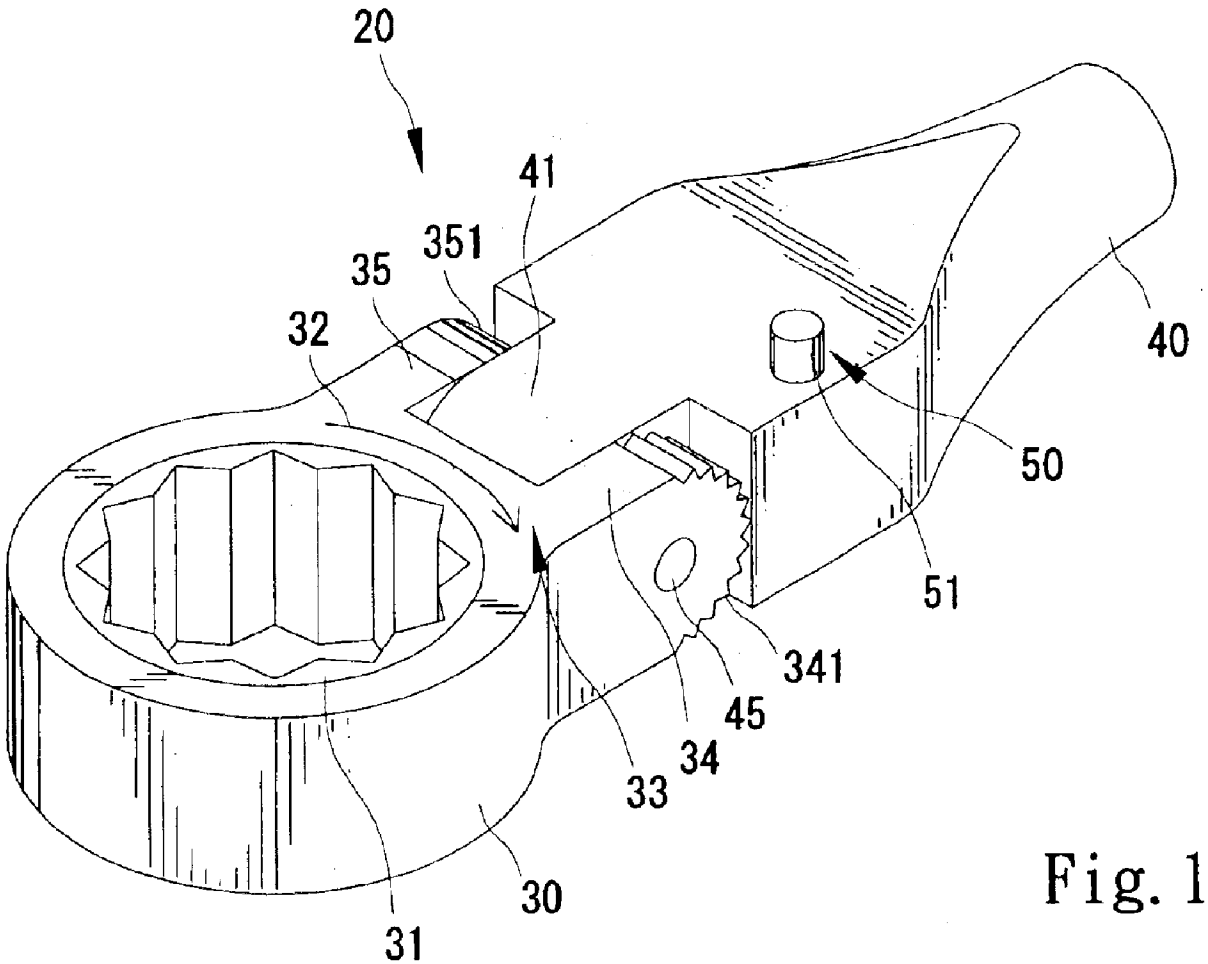
FIG. 10 is a perspective view of a modified embodiment of the wrench in accordance with the present invention.
Figure 11:
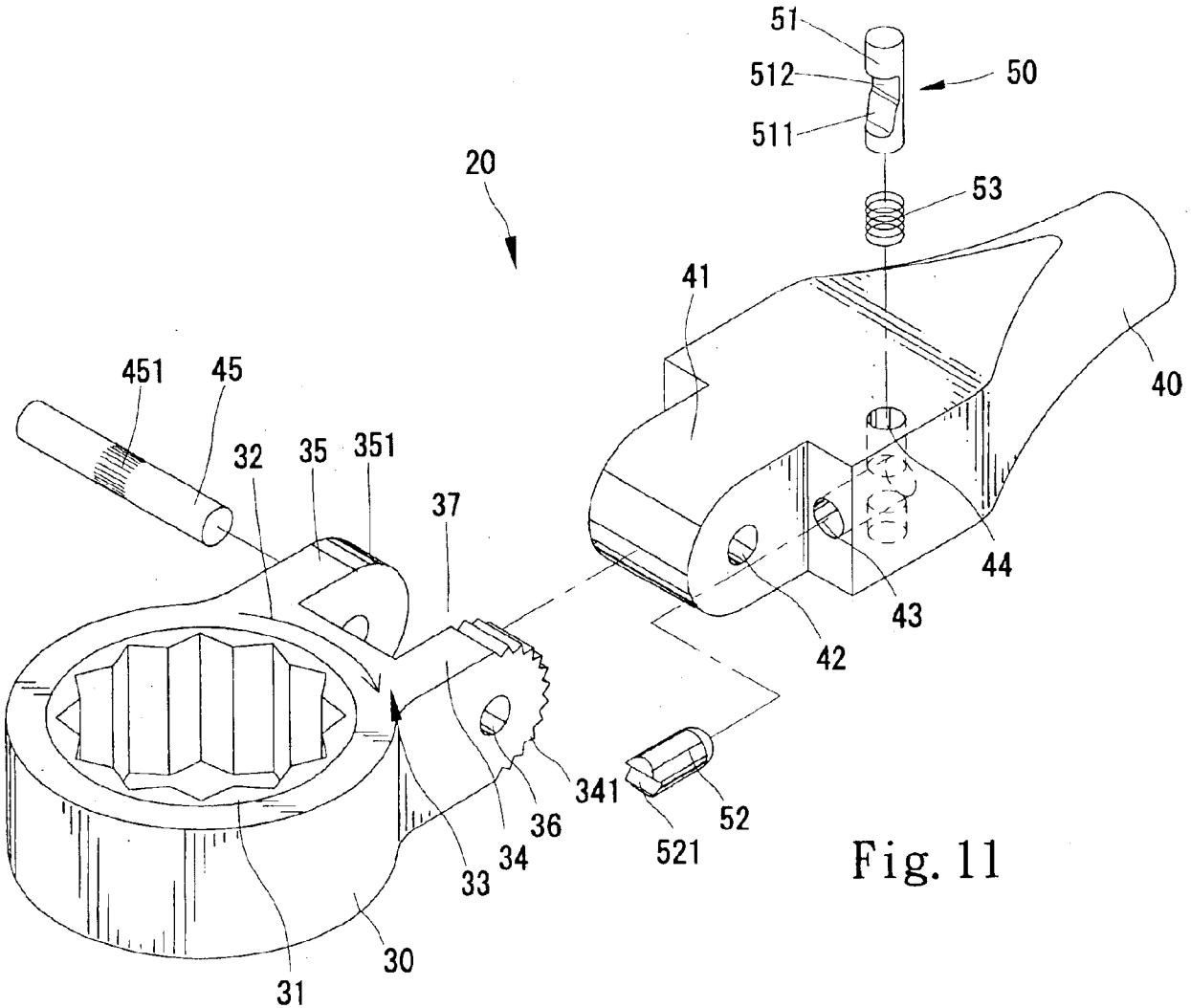
FIG. 11 is an exploded perspective view of the modified embodiment in FIG. 10.

FIGS. 10 and 11 illustrate a modified embodiment of the invention, wherein the receptacle 44 is orientated in a vertical direction; namely the receptacle 44 opens in a top of the handle 40.

Although the invention has been explained in relation to its preferred embodiments, it is to be understood that many other possible modifications and variations can be made without departing from the scope of the invention as hereinafter claimed.

What is claimed is:

1. A wrench comprising:

a handle including an end having an engaging portion;

a head including a pivotal portion pivotably connected to the end of the handle, the pivotal portion of the head including a fore lug and a rear lug that are located with reference to a ratcheting direction of the handle, an opening being defined between the fore lug and the rear lug, the engaging portion of the handle being received in the opening and pivotable about a pivotal axis, each of the fore lug and the rear lug having an arcuate outer surface section, a plurality of teeth being defined in the arcuate outer surface section of the fore lug;

a retaining mechanism for releasably engaging with the teeth of the fore lug, allowing the head to be pivotally moved to a desired position relative to the handle and retaining the head in the desired position; and an axial hole defined in the end of the handle and having a first end and a second end, with the second end of the axial hole facing the teeth of the fore lug, with the retaining mechanism including a catch slideably mounted in the axial hole and urged to be engaged with the teeth of the fore lug.

2. The wrench as claimed in claim 1, with the engaging portion of the handle including a pin hole, with the fore lug and the rear lug having aligned pin holes, and with a pin extending through the pin holes of the fore lug and the rear lug and through the pin hole of the engaging portion of the handle.

3. The wrench as claimed in claim 1, with the end of the handle including a receptacle extending in a direction perpendicular to a longitudinal direction of the handle, with the first end of the axial hole communicated with the receptacle with the retaining mechanism including an elastic element and a push member mounted in the receptacle, with the catch being urged by the push member, under an action of the elastic element, to be engaged with the teeth of the fore lug.

4. The wrench as claimed in claim 3, with the push member including a recessed portion having a first face and a second face that is located in a level different than that of the first face.

5. The wrench as claimed in claim 1, with the head including a drive member mounted therein for engaging and driving a fastener, with the wrench further including a mark for indicating a ratcheting direction of the drive member.

6. The wrench as claimed in claim 3, wherein the receptacle opens in one of two lateral sides of the handle.

7. The wrench as claimed in claim 3, wherein the receptacle opens in a top of the handle.

8. The wrench as claimed in claim 2, wherein a distance from a dedendum circle of the teeth of the fore lug to a periphery delimiting the pin hole of the fore lug is smaller than that of a distance from the arcuate outer surface section of the rear lug to a periphery delimiting the pin hole of the rear lug.

9. The wrench of claim 1 with a distance from a dedendum circle of the teeth of the fore lug to the pivotal axis being smaller than that of a distance from the arcuate outer surface section of the rear lug to the pivotal axis.

* * * * *